United States Patent [19]

Barkan

[11] Patent Number: 4,663,504

[45] Date of Patent: May 5, 1987

[54] LOAD BREAK SWITCH

[75] Inventor: Philip Barkan, Stanford, Calif.

[73] Assignee: Raychem Corporation, Menlo Park, Calif.

[21] Appl. No.: 896,563

[22] Filed: Aug. 13, 1986

Related U.S. Application Data

[63] Continuation of Ser. No. 598,556, Apr. 9, 1984, which is a continuation-in-part of Ser. No. 483,471, Apr. 11, 1983, abandoned.

[51] Int. Cl.[4] ..... H01H 33/88; H01H 33/54

[52] U.S. Cl. ..... 200/148 A; 200/148 B; 200/302.3

[58] Field of Search ..... 200/148 A, 148 R, 148 B, 200/302, 302.3, 83 W, 145

[56] References Cited

U.S. PATENT DOCUMENTS

| | | | |
|---|---|---|---|
| 1,706,746 | 3/1929 | Rice | 200/148 B |
| 2,137,880 | 11/1938 | Loesser | 200/84 |
| 2,419,074 | 4/1947 | Herbert | 286/29 |
| 2,454,340 | 11/1948 | Reichel | 286/29 |
| 2,742,548 | 4/1956 | Cole | 200/302.3 |
| 2,794,931 | 6/1957 | Gardner | 313/85 |
| 2,860,933 | 11/1958 | Wolff | 308/238 |
| 2,941,407 | 6/1960 | Huber et al. | 74/18.1 |
| 3,030,481 | 4/1962 | Gussow et al. | 200/148 R |
| 3,114,815 | 12/1963 | Easley et al. | 200/148 A |
| 3,248,511 | 4/1966 | Heilman | 200/302.3 |
| 3,424,884 | 1/1969 | Floessel et al. | 200/148 R |
| 3,542,986 | 11/1970 | Kotski | 200/149 |
| 3,641,295 | 2/1972 | Ferton et al. | 200/148 A |
| 3,755,637 | 8/1973 | Gloviak et al. | 200/302 |
| 3,947,650 | 3/1976 | Strain et al. | 200/148 B |
| 3,970,811 | 7/1976 | Krebs | 200/148 |
| 4,020,307 | 4/1977 | Strubin | 200/148 B |
| 4,105,880 | 8/1978 | Rapp et al. | 200/145 |
| 4,107,498 | 8/1978 | Golota | 200/148 B |
| 4,153,827 | 5/1979 | Mircovich et al. | 200/144 B |
| 4,187,437 | 2/1980 | Muller et al. | 361/334 |
| 4,236,054 | 11/1980 | Karrenbauer et al. | 200/145 |
| 4,412,115 | 10/1983 | Okuno | 200/148 R |
| 4,427,862 | 1/1984 | Lin | 200/252 |

FOREIGN PATENT DOCUMENTS

| | | | |
|---|---|---|---|
| 1103435 | 3/1961 | Fed. Rep. of Germany . | |
| 50-40286 | 11/1975 | Japan . | |
| 52-19939 | 5/1977 | Japan . | |
| 54-73281 | 6/1979 | Japan . | |
| 54-158646 | 12/1979 | Japan | 200/148 R |
| 57-9017 | 1/1982 | Japan . | |
| 205420 | 8/1965 | Switzerland | 200/148 F |

OTHER PUBLICATIONS

"Operating Principles of Medium-High-Voltage Circuit-Breakets of Small-Oil Volume -Vacuum-$SF_6$", by Karl Stegmuller-*Elektrizitatswirtschaft*, vol. 81, (1982) Booklet 22.

*Primary Examiner*—Robert S. Macon

*Attorney, Agent, or Firm*—Edith A. Rice; Herbert G. Burkard

[57] ABSTRACT

A single-phase ground enclosed load break switch for distribution voltages has a hermetically sealed cylindrical metal housing of from 2 to 6 inches diameter which contains an insulating gas under pressure. The switch has a movable contact assembly to contact a pair of opposed stationary coaxial conductors within the housing. Movement of the contact assembly along one conductor breaks the connection with the other conductor and simultaneously reduces the sliding contact force on the first conductor. The switch has conductive bands coaxially positioned near the housing around the conductors for low voltage measurements monitoring conductor energization and contact position. A rocking bellows at the fulcrum of a crank actuator provides a compact hermetic seal for the actuator without excessive strain of the bellows. A safety interlock with a visual indicator locks the contact assembly in case of a loss of pressure. Excessive pressure in the switch causes the bellows to be punctured with consequent locking of the contact assembly. The switch is small enough to be mounted directly on a transformer or placed into a cable, without the need for a separate enclosure.

49 Claims, 9 Drawing Figures

LOAD BREAK SWITCH

CROSS-REFERENCE

This application is a continuation of application Ser. No. 598,556, filed 4/9/84, which is a continuation-in-part of application Ser. No. 483,471, filed Apr. 11, 1983, abandoned which is incorporated herein by this reference.

BACKGROUND

This invention relates to a ground enclosed, load-break switch particularly adapted for use in medium voltage power distribution systems in the range about 1 to about 36 kilovolts (kv) for interrupting currents of up to about 1 kiloampere (ka).

Load break switches used in medium voltage power distribution range circuits generally include a pair of electrodes, one being stationary and the other movable to open and close the circuit. As commonly used in three-phase systems, three or multiples of three switches are mounted in a common grounded metal enclosure. The switches are of four general types. Air break switches were the first developed. Such switches rely on air for insulation. Since air is a relatively poor insulator, relatively large clearances are required to be maintained around each switch for insulating from ground potential. Further, the contacts of the switch must be separable by a relatively large gap in order to break and isolate the circuit when the switch is opened. These switches are consequently very large and must be provided with extremely large enclosures. Therefore, air break switches are often impractical in medium power distribution systems because of the high manufacturing cost, consumption of available space, and unsightly appearance dictated by their shear bulk.

Oil insulated switches represent a significant size improvement over air break switches. Oil is both an effective insulator and arc quenching medium. This enables an oil insulated switch to be enclosed in a relatively compact grounded housing. Therefore, oil insulated switches take considerably less space than that required for a corresponding air break switch for use in the same voltage and current range. However, oil is inflammable, creating a fire hazard. Another disadvantage of an oil insulated switch is that gases generated by the arc drawn in the oil generate high pressures, posing an explosion hazard, and the accumulation of gases require special accomodations, such as venting. A further disadvantage is the danger of water contamination of the oil, which can drastically reduce the dielectric strength of the oil.

An oil switch for use in the medium voltage distribution system typically comprises a metal housing, which is grounded and filled with oil. In the typical three phase configuration, a single metal housing includes at least three switches, one for each phase, or multiples of three such switches, immersed in the oil.

Another class of load break switches employs vacuum interrupters. In these switches, the contacts are enclosed in an evacuated chamber. The vacuum environment rapidly dissipates the gaseous products of the arc drawn between the contacts of the switch to effect interruption of the current when the switch is opened. Typically, three or more such vacuum interrupters are mounted within a grounded metal enclosure. The enclosure contains an insulating medium which surrounds each vacuum interrupter. The insulating medium can be air, oil or sulfur hexafluoride.

The disadvantages and limitations of vacuum switches include the following:

1. Random breakdowns in the open position due to surface imperfections of the contacts dictate an auxilliary disconnect means that operates following current interruption.
2. The proper vacuum state of $10^{-5}$ torr is very difficult to monitor.
3. The presence of a floating ring at contact potential within the interrupter precludes practical operation of the vacuum envelope at ground potential.
4. The high frequency characteristics of the vacuum switch can cause over voltages.
5. The vacuum switch presents special problems when capacitive or inductive loads are involved.
6. There are wide statistical variations in vacuum dielectric and insulation characteristics.

Another class of load break switches for distribution systems is gas insulated switches which employ a gas for both insulation and interruption. Sulfur hexafluoride ($SF_6$), either alone or mixed with other gases such as nitrogen, is used. Such switches can be of the gas-blast or puffer type in which the arc quenching gas is caused to flow across the contacts as the arc is formed. The relatively high velocity flow of dense gas along the arc rapidly extinguishes the arc at a natural current zero of the alternating current. In a typical three phase configuration, a grounded metal enclosure surrounds three, or multiples of three, switches. Each individual switch typically comprises an unsealed cylindrical housing of a plastic such as reinforced epoxy resin. A grounded metal housing filled with sulfur hexafluoride surrounds the interrupters with substantial clearance to prevent arcing. The $SF_6$ within the common enclosure and within the individual switches is generally maintained at about atmospheric pressure in distribution class switches involving multiple interrupters. A higher pressure within the housing is not practical because the conventional gaskets and moving seals are subject to leakage and because the high mechanical stresses that are developed in the relatively large common housing require a prohibitively massive enclosure. Consequently, a pressure only high enough to prevent a vacuum condition at low temperatures is used, that is, 1.2–1.4 atmospheres at 60° F. which is sufficient for positive pressure at a minimum temperature of −40° F.

A disadvantage of each of the above described switches is that they are very heavy and bulky. Thus they require special foundations and large vaults and enclosures in which they are mounted, resulting in high installation costs, unsightly appearance, and demanding large amounts of critical space. The bulk of these switches is particularly undesirable in urban and residential areas.

Another problem with these types of switches is abrasion and mechanical wear of the contacts. The movable and stationary contacts can be solid conductors that butt against each other to close the electrical circuit. This contact configuration has the disadvantages of contact bounce and high impact stress when the switch is closed, and high contact resistance when arcing by-products or corroded materials are trapped between the contacts. To avoid these problems, a wiping contact configuration can be used. In some designs one of the contacts has a hollow cylindrical configuration while the other is a solid cylinder which fits inside the hollow cylindrical portion of the other contact. The hollow cylindrical portion can have a solid wall configuration or can be a cluster of fingers such as that disclosed in U.S. Pat. No. 3,970,811 to Krebs. The operation of the circuit interruptor results in the surface of the contacts sliding with respect to each other. This can result in degradation of the dielectric by the wear particles from the contacts. This further reduces the effective life of the contacts, and requires expensive maintenance for repair.

Another problem with cylindrical finger contacts is the difficulty of maintaining proper axial alignment for contact engagement when the switch is closed.

An additional problem with gas filled switches is that the pressure within the enclosure can degrade to an unsafe level at which the arc developed upon opening the switch might not be quenched, resulting in rapid heating and vaporization of the contacts, and in some instances, an explosion. A pressure guage can be provided, but this does not prevent opening the switch and it constitutes an additional source of leakage.

An additional problem with sealed switches is that a malfunction within the switch can cause uncontrolled arcing, heating and consequent vaporization of metallic contacts. This increases the internal pressure of the switch and creates the safety hazard of a possible explosion of the switch.

An additional problem with distribution switches is the need for a convenient means of detecting line voltage energization of each conductor and the position of the switch contacts. Direct measurement of the high voltage levels involved is cumbersome and dangerous, and the position of enclosed contacts is not certain when the contacts are either both energized or both unenergized. For convenience, this monitoring should be possible at locations remote from the switch.

A further problem with distribution switches is the need for remote operation of the contacts. This need has been described, for example, in U.S. Pat. No. 4,187,437 to Muller, et al. The cost of remote actuation in the prior art is high because of the great energy required to operate conventional switches.

In medium voltage distribution systems, another device which can be used to interrupt current is the so-called "load break" elbow connector. Such load break elbows enjoy advantages including their small size, capability of being connected directly to a bushing and/or cable, and their submersibility, making them suitable for use in both surface and underground vault locations. However, they have important limitations and difficulties:

1. Load breaking is limited to 200 amperes and below.

2. With the load break separable elbow, a considerable personnel hazard exists, since the disconnection is drawn directly into the atmosphere and there is no shielding or protection for the operator who is required to stand in front of the device. An arc can be drawn in the open, thus creating a danger that the arc can jump to ground, thereby generating a major arcing fault of extremely high current magnitude which can be fatal to anyone in the vicinity, and destructive of any equipment.

3. Proper disconnection depends on the skill and strength of the operator using a hot stick to jerk the elbow from its connection.

4. The useful life of an elbow connector is limited to a relatively few operations since erosion of the mating parts by arcing can greatly reduce the effectiveness of the device to interrupt currents. There is some danger associated with such degradation.

5. Load break elbows are limited to single phase operation and where used on a three phase system there is necessarily a relatively long time interval between the opening or closing of the individual phases. This can cause in some cases the phenomenon of ferro-resonance with serious overvoltage consequences. In many parts of the world, only three phase switches are acceptable.

6. The right angle bend introduced by the elbow triggers a requirement that a full cable loop be included within the enclosure. These cable loops in distribution lines are extremely large, dominating the required space within the enclosure.

7. After prolonged connection, an elbow connector can stick to the mating configuration, resulting in an inordinate force being required for disconnection.

As a consequence, the use of load break elbows for load switching or load transfer is frequently restricted. These elbow connections are generally limited to operation on de-energized circuits, and conventional switching devices as described above must first be operated to de-energize a line before the elbow connector can be operated.

Since these conventional switches can be in locations remote from the particular elbow connector, a time consuming and elaborate procedure must be followed before the "pulling" of an elbow connector is permitted. These procedures involve considerable travel between points remote from each other. The time and distances of perhaps several miles introduce the hazard of inadvertant error or misoperation. As a consequence, all of this difficulty greatly extends the time that a circuit must be de-energized before a switching operation can be safely carried out.

In view of these problems, there is a need for a medium voltage load-break switch that is of small size and weight so that it can be used without special foundations and vaults, does not require cable loops, uses an insulating medium that does not present a fire hazard, has a long life, required substantially no maintenance, can be removely monitored, and is easy to de-energize.

SUMMARY

The present invention is directed to a switch that satisfies these needs. The switch comprises a housing, first and second opposed conductors in the housing, the conductors preferably being stationary, and a contact assembly between the conductors. The contact assembly is movable between a first closed position in electrical contact with both conductors and a second open position in contact with only the second conductor. By the term "closed", reference is being made to a position where the switch closes the electrical circuit in which the switch is located so that the circuit is capable of conducting an electrical current; "open" refers to the position in which the switch opens the circuit in which it is located so that the circuit is not capable of conducting an electrical current.

Preferably, the opposed conductors are coaxially mounted in a cylindrical housing.

The contact assembly comprises a plurality of substantially equally spaced, electrically conducting rods arranged in a cylindrical configuration around the conductors. The rods are always in sliding contact with the second conductor and in sliding contact with the first conductor only when proximate to the closed position. Biasing means are provided for exerting an inwardly directed contact force on the rods toward both conductors. This contact force is at a first level when the contact assembly is in the closed position and at a second level when the contact assembly is not in contact with the first conductor. The first level is greater than the second level. Thus, the switch is maintained securely closed with good electrical contact between the rods and the conductors when the switch is closed. This assures low heating in the closed position at rated current levels. In the event of a fault current, the contact configuration produces significant magnetic forces on the contacts to suppress "popping", the forcing apart of the contacts by electromagnetic repulsion forces at extremely high current levels. However, when the switch is opened, the contact force is greatly reduced, thereby minimizing mechanical abrasion of the contact assembly and the conductors. The greatly reduced contact force results in a corresponding reduction in the energy and mechanical forces required for moving the contacts.

The biasing means can be leaf springs having opposed first and second ends, with the first ends pressing the rods toward the first conductor and the second ends pressing the rods toward the second conductor when the contact assembly is in the closed position. When the contact assembly is moved away from the first conductor so that the rods are no longer in contact with the first conductor, there is no longer any force exerted on the first conductor and the force on the second conductor is greatly reduced.

Preferably the switch has a ground cylindrical housing and contains a pressurized insulating gas and hermetic means for permanently sealing the housing. Preferably the housing has a small diameter cylindrical side wall, with the conductors coaxial at opposite ends. Such a switch having a diameter of less than about 6 inches (150 mm) can be used in a circuit of from 1 kilovolt to 36 kilovolts for continously carrying and interrupting up to 1 kA load currents.

To obtain a hermetically sealed switch, preferably an actuating arm protruding through the side of the housing is provided with a bellows hermetically sealed to the arm and the housing, the arm being movable between first and second positions as the bellows deflects in rocking mode. The arm can be pivoted on an axis passing through the bellows to produce rocking mode deflection of the bellows. Linkage means connecting the arm to the contact assembly is provided so that by moving the arm between its first and second positions the contact assembly is correspondingly moved between the closed position and the open position. The rocking bellows makes practical a hermetically sealed, pressurized switch not requiring work to be done compressing the insulating gas when the actuating arm is operated. The mounting of the rocking bellows and lever actuating arm on the side of the housing allows the conductors to be axially aligned in a compact switch that can be connected in line in an electrical circuit not requiring cable loops.

The energy required for operation of the switch is greatly reduced by the combination of the short contact stroke and low contact forces made possible by the high pressure of insulating gas that can be used in the small diameter hermetically sealed housing and the rocking bellows that does not compress the gas, the cylindrical arrangement of contact rods that is not subject to popping at moderate contact forces, and the reduction in contact force when the rods are in sliding contact only with the second conductor.

The switch can be provided with an insulating liner that functions as a cylinder for a puffer-type piston contact assembly. The insulating liner can be spaced apart from the housing providing an annular space between the liner and the housing. Preferably sealing means are provided in this annular space to separate the annular space from the portion of the housing containing the second conductor. Preferably the volume in the portion of the housing containing the first conductor, combined with the volume of the annular space, is greater than the volume containing the second conductor opposite the contact assembly. This reduces back pressure at the puffer nozzle caused by heating of the insulating gas by an arc. Preferably this greater volume is obtained with the insulating sleeve located near the housing in a region of relatively low electric field. Thus there is no need to provide a conventional bulkhead within the cylinder to limit the volume of insulating gas compressed by the piston.

The insulating liner can be provided with conductive bands at each end to function as capacitive electrodes for monitoring the position of the contacts and the voltage present at the first and second conductors. Each conductive band operates as a capacative voltage divider to permit local or remote low voltage measurements proportional to the voltages at the respective first and second conductors. When only one of the conductors is energized, a further indication that the contacts are in the open position is given. When the conductors are both energized, or both not energized, the position of the switch contacts can be measured by coupling a high frequency voltage source to one of the conductive bands and making a frequency discriminating voltage measurement of the other conductive band. The open position of the contacts is indicated by a reduced measured voltage at the second conductive band caused by the small series capacitance introduced by the open switch contacts, whether the conductors are energized or not.

Thus, it has now been discovered that an individual single phase load break switch suitable for use at voltages of up to 36 kV and currents of up to 1 kA can be enclosed in a ground enclosure from two to six inches in diameter containing an insulating gas under a pressure of at least 1.5 atmosphere absolute. This is contrary to prior art teaching in which distribution class single phase switches are not individually enclosed in grounded enclosures, but several such switches are enclosed in a common ground enclosure. Further it has unexpectedly been found that this novel ground enclosed single phase switch can have greatly simplified operating features compared to prior art switches of this class. In addition, the individual ground enclosed switch can be readily inserted into distribution systems as it can, for example, be secured to a transformer bushing using an elbow connector or can be spliced directly into a cable of the system without the need to provide special vaults or separate enclosures to accomodate these switches.

Further, it has unexpectedly been found that in spite of the very small volume of the switch, no significant pressure rise (either transient or permanent) arises from the interruption of load currents.

In one aspect of this invention, a single phase ground enclosed load break switch for use in electrical circuits in the voltage range of from about 1 to about 36 kilovolts comprises:

(a) a sealed cylindrical metal housing having a diameter in the range of from about 2 to about 6 inches;

(b) first and second bushing means coaxially penetrating said cylindrical metal housing, one of said bushings being mounted proximate one end of said housing and the other being mounted proximate the other end of said housing, each of said bushings having an electrical conductor therethrough;

(c) a contact assembly capable of assuming a first position in which it is in physical and electrical contact with the electrical conductor of each of said bushings and a second position in which it is physically and electrically separated from at least one of said conductors;

(d) means for causing said contact assembly to move from said first position to said second position, thereby causing said contact assembly to be separated from at least one of said conductors thus interrupting current flow through the switch and from said second position to said first position, thereby causing said contact assembly to be in contact with each of said conductors thus providing a path for current flow through the switch; and (e) an insulating gas in said housing maintained at a pressure of up to about 5 atmospheres absolute; said switch being adapted to be electrically connected between a load and a power source having a voltage in the range of from about 1 to about 36 kilovolts.

Another aspect of this invention provides an assembly comprising:

(A) single phase ground enclosed load break switch for use in electrical circuits in the voltage range of from about 1 to about 36 kilovolts which comprises:

(a) a sealed cylindrical metal housing having a diameter in the range of from about 2 to about 6 inches;

(b) first and second bushing means coaxially penetrating said cylindrical metal housing, one of said bushings being mounted proximate one end of said housing and the other being mounted proximate the other end of said housing, each of said bushings having an electrical conductor therethrough;

(c) a contact assembly capable of assuming a first position in which it is in physical and electrical contact with the electrical conductor of each of said bushings and a second position in which it is physically and electrically separated from at least one of said conductors;

(d) means for causing said contact assembly to move from said first position to said second position, thereby causing said contact assembly to be separated from at least one of said conductors thus interrupting current flow through the switch and from said second position to said first position, thereby causing said contact assembly to be in contact with each of said conductors thus providing a path for current flow through the switch; and (e) an insulating gas in said housing maintained at a pressure of from about 1 to about 5 atmospheres absolute;

(B) a transformer having an output voltage range of from about 1 to about 36 kV, said transformer being equipped with an outlet bushing; and (C) a separable elbow connector comprising a molded elastomeric body portion having first and second bushing wells adapted to receive and electrically interconnect bushings of electrical equipment; the first bushing well being connected with a bushing of said switch and the second bushing well being connected with an outlet bushing of said transformer.

DRAWINGS

These and other features, aspects, and advantages of the present invention will become better understood with reference to the following description, appended claims, and accompanying drawings where:

DESCRIPTION

Figure 1:
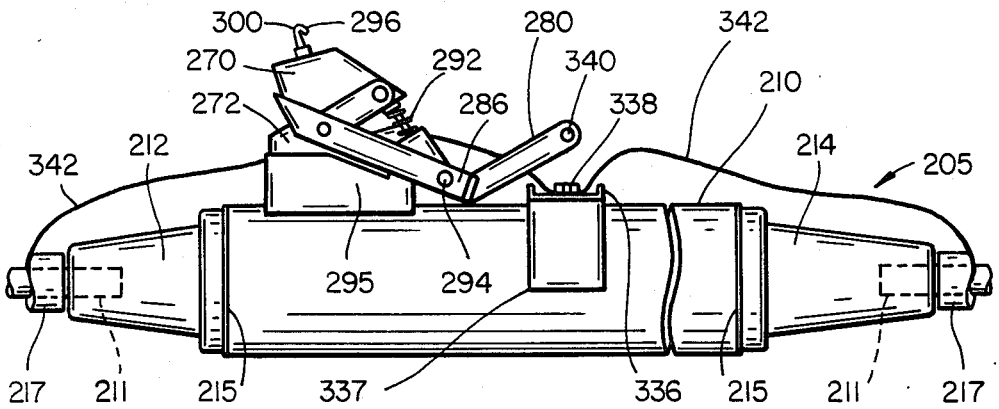
FIG. 1 is a side elevation view of a switch having features of the present invention, the switch including a contact assembly and an actuator.

The switch of this invention is in a grounded enclosure comprising a metal housing of a generally cylindrical configuration. The term "generally cylindrical" is used herein to mean that the housing is substantially cylindrical but not necessarily of circular cross-section. Although less preferred, oval and similar cross-sections can be employed, if desired. The housing can be grounded by connecting it by an appropriate conductor to ground. The housing is hermetically sealed and thus is gas-tight, as well as submersible in water without damage. This makes the switch suitable for underground applications where flooding is a possibility or in environments not compatible with air insulation. In this specification, a hermetic seal is defined as a gas-tight seal effective to limit the total leakage from a pressurized enclosure into the atmosphere to less than $10^{-6}$ cc/sec measured at atmospheric pressure.

The switch of this invention contains within the housing an insulating gas maintained under positive pressure, i.e. greater than 1 atmosphere absolute. The gas is preferably sulfur hexafluoride (also referred to herein as $SF_6$). The gas pressure utilized in a particular switch depends on the voltage and current ranges of the switch, its size and the presence of a puffer mechanism, or other gas blast device used. The gas pressure is in the range of greater than 1 atmosphere to about 5 atmospheres absolute, and preferably from about 1.5 to about 5 atmospheres absolute, for $SF_6$ insulated switches in the 15-36 kV range. The hermetically sealed housing permits pressures in this range to be maintained for periods in excess of twenty years.

A pair of bushings are mounted in the housing. Each bushing comprises a metal conductor within and protruding through an insulator, i.e. a plastic such as epoxy or a ceramic material. A metal mounting flange is molded into the plastic and is welded to the wall of the ground enclosure of the switch. The metal conductor of the bushing extends through the bushing for conducting electricity into the switch. The conductor can be a rod of a suitable metal, generally copper or aluminum. Where aluminum is used, preferably the aluminum extension is enclosed where the contacts engage in a metal more appropriate for arcing or sliding contact.

Preferably bushings are installed coaxially at the ends of the substantially cylindrical housing with the bushing conductors extending axially through the housing end. This permits an inline circuit configuration not requiring power cable loops and allows a small diameter housing suitable for high levels of pressurization to be used.

The interruption of high power circuits requires the dissipation of substantial amounts of heat by the switch. The primary mode of heat dissipation is by conduction from the switch contacts through the conductors to the external power cable. Secondarily, heat is conducted from the conductors through the bushings into the housing. It is important, therefor, to keep the length of the conductors short. The inner length of the conductor, i.e. that portion of the conductor extending into the body of the switch, depends primarily on the contact stroke used. The conductors must be sufficiently long to make physical and electrical contact with the contact assembly when it is in its first, or closed, position and must accommodate the movement of the contact assembly into its second or fully open position. The additional length of the conductor within the portions of the bushings internal to the housing depends upon the surface distance required along the insulating material of the bushings to prevent arcing to the housing. Because the insulating gas within the housing can be maintained at high pressure, both a short contact stroke and a short internal bushing length can be used.

The contact assembly is capable of assuming a first position in which it is physically and electrically connected with the conductors of each bushing. In this first closed position, the contacts of the assembly must be capable of carrying continuous current. According to its rating, the switch is capable of conducting continuous current up to at least 200 amperes in the lowest rating and up to at least 1000 amps (or 1 kA) and possibly higher. The contact assembly is also capable of assuming a second position in which it is separated from a first conductor of one of the bushings to interpose a gas insulated gap in the circuit path thereby interrupting current flowing through the switch. The switch is capable of opening under normal current load and closing into high fault currents of such as 12,000 amps, 25,000 amps, or even higher in accordance with standard short circuit ratings.

The contact assembly generally moves in an axial direction. As it moves into or out of contact with the first bushing conductor an arc forms between the contact assembly and the conductor. As discussed in more detail below the arc is quenched by te pressurized insulating gas.

Figure 2:
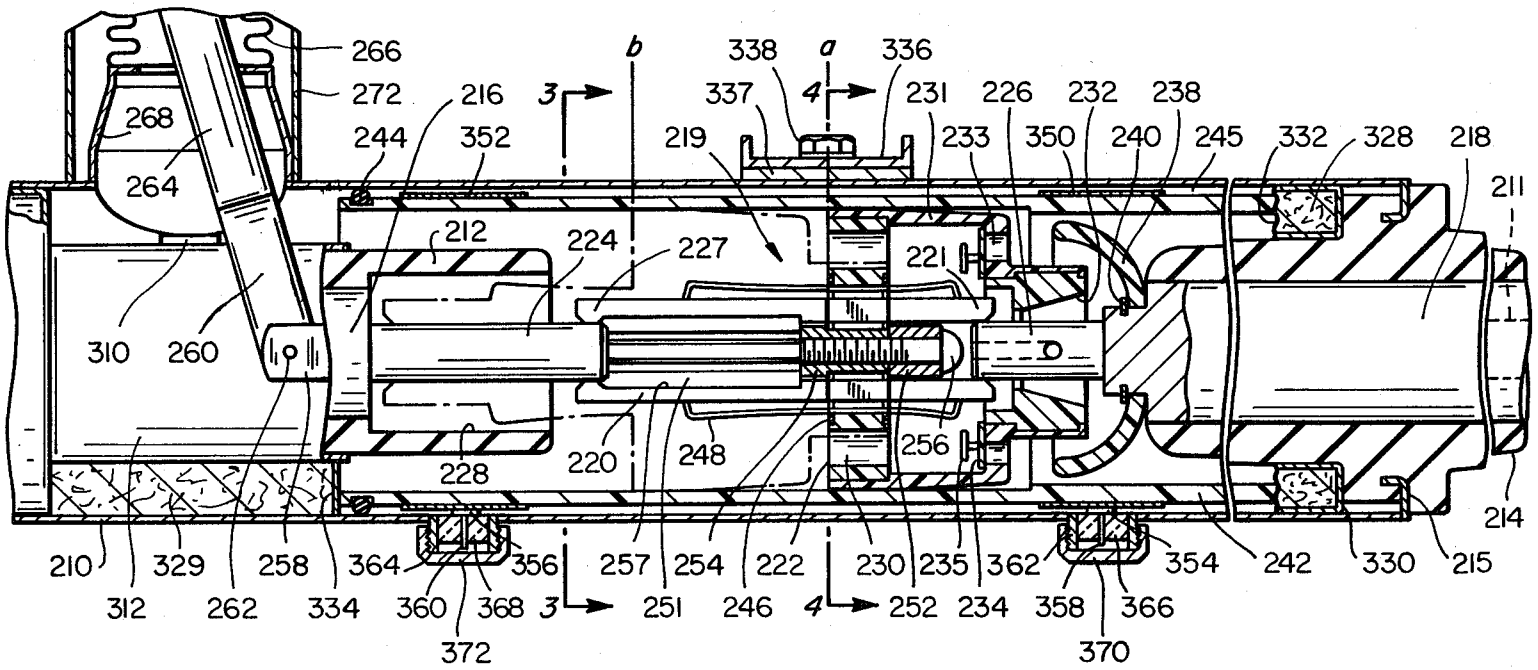
FIG. 2 is a detailed vertical sectional view of the contact assembly portion of the switch of FIG. 1.
Figure 3:
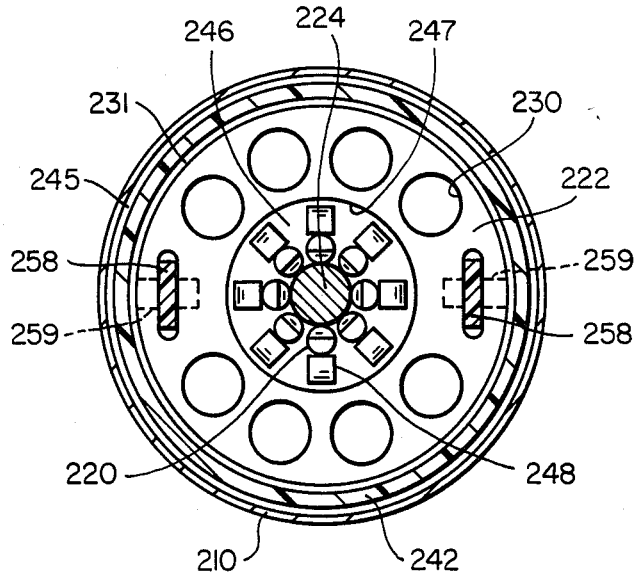
FIG. 3 is a lateral sectional view of the switch of FIG. 1 taken along line 3—3 in FIG. 2.
Figure 4:
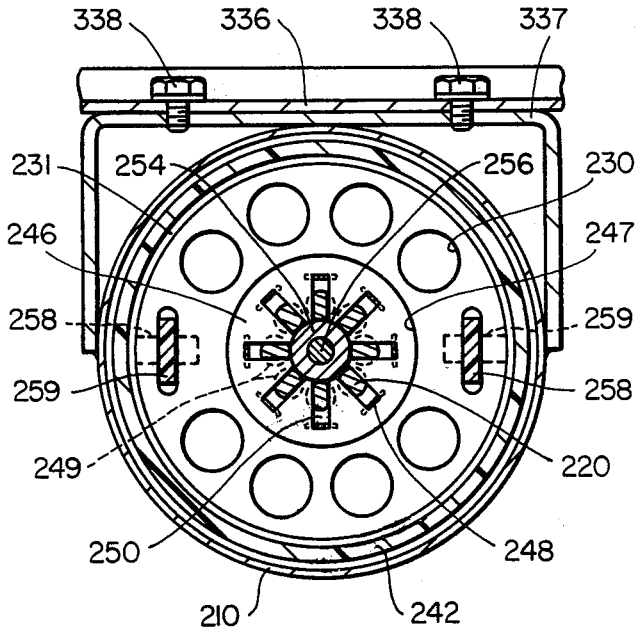
FIG. 4 is another lateral sectional view of the switch of FIG. 1 taken along line 4—4 in FIG. 2.

Preferably the contact assembly comprises a plurality of elongated, electrically conductive contact rods arranged in a hollow cylindrical configuration. The contact rods are preferably of a highly conductive material such as copper. The contact rods are maintained in a cylindrical configuration by being mounted in a holding means providing a radial slot for each rod. The holding means can be an axially slidable piston used for pumping insulating gas as described below, where the piston is made of an insulating material such as molded plastic. The radial slot configuration retains the contact rods in a cylindrical configuration spaced from one another, and notches in the contact rods engage the slots for axial location of the contact rods by the piston. The slots in the holding means can be provided by appropriately configurated washers as illustrated in FIGS. 2, 3 and 4 and discussed in more detail below.

The contact assembly is preferably provided with a guide for maintaining the contact assembly in proper axial alignment with the other components. This guide can be a cylinder for the piston.

The piston preferably has a relatively open spider configuration to allow the insulating medium to circulate in the housing. The housing can contain a puffer assembly, for example in a gas insulated interruptor device, to force a flow of arc quenching gas across the gap formed between the first conductor and the contact assembly when the circuit is opened or closed. A puffer device can be conveniently incorporated into the design of the piston, if desired. The piston comprises a relatively solid cylindrical block having a number of holes or passageways drilled through it. When the contact assembly is moved from its first to its second position the insulating gas is forced through the holes and directed to the gap formed between the first electrode and the contact assembly. In such embodiments of the invention the conductive rods of the contact assembly can be mounted on the aligning means so that the surfaces of the rods in contact with the first electrode are positioned relatively close to the holes through the aligning means.

The contact assembly comprises a spring associated with the contact rods such that when the assembly is in its first position, that is in contact with each of the conductors, the contact rods exert a maxinum inward contact force on the conductors. This assures low contact resistance and high heat transfer across the closed contacts. The springs can be, for example, leaf springs mounted on each of the conducting rods. Other springs such as a spiral or garter spring mounted around the conducting rod assembly, individual radial springs mounted on each rod, or any other means which provides an inward force on the conducting rods can be used.

To open the switch the contact assembly is moved from the first to the second position, that is the piston is moved so that the contact rods no longer contact both conductors. The assembly can be moved by means of a linking arrangement connected with the piston which is activated by a handle or actuator located external to the housing. As described more fully below with reference to the accompanying drawings, opening of the switch, that is moving the switch to its second position, causes the contact rods to move away from the first electrode. An arc between the leading edges of the contact rods is extinguished by the insulating gas. The inward force applied to the contact rods causes the rods to be pushed inward against a spacer as soon as the contact rods are no longer in contact with the first conductor. The spring is associated with the contact rods in such a manner that when the contact rods are forced inwardly against the spacer upon disengagement with the first conductor, the force on the opposing ends of the contact rods against the second conductor is greatly reduced. A contact force of from about 2 to about 4 pounds is adequate when the contact rods having a cylindrical arrangement contact both conductors. When the contact rods disengage with the first conductor, the contact force against the second conductor is reduced to approximately 1 pound. The contact rods remain in contact with the second conductor so that current resulting from the arc between the leading edge of the rods and the first conductor is transferred to the second conductor. The contact assembly is drawn away from the first conductor a sufficient distance to provide a gap such that the arc between the first conductor and the contact rods does not regenerate after it has been quenched. The reduced force on the rods and the second conductor.

Generally, it has been found that when the contact assembly is used in a load-break switch in a 200 ampere, 15 kV circuit, the piston can have a relatively open "spider" configuration. When used in a 600 ampere, 15 kV circuit a puffing mechanism is preferably provided.

For the puffing mechanism to be effective, the flow of insulating gas must continue after the contacts have separated a distance sufficient to prevent regeneration of the arc until a subsequent current reversal occurs. Because synchronization of contact opening with line frequency is not practical, the flow of quenching gas must continue for at least half a cycle to insure quenching flow after the contacts have separated beyond the arc regeneration distance. Because it is also desired to minimize the heat generated by the arc, quenching should be completed within a short time interval. The switch of the present invention can be operated with a short contact stroke with corresponding low contact velocity within a time frame dictated by the above considerations. Since the low contact velocity greatly reduces the kinetic energy necessary for operating the switch, light weight construction of the moving parts is possible, so that a very low power actuator can be used.

By making all of the components other than the contact assembly of an appropriate insulating medium, it is possible to produce a ground enclosed compact switch in which the ground enclosure is less than 6 inches in diameter.

Figure 7:
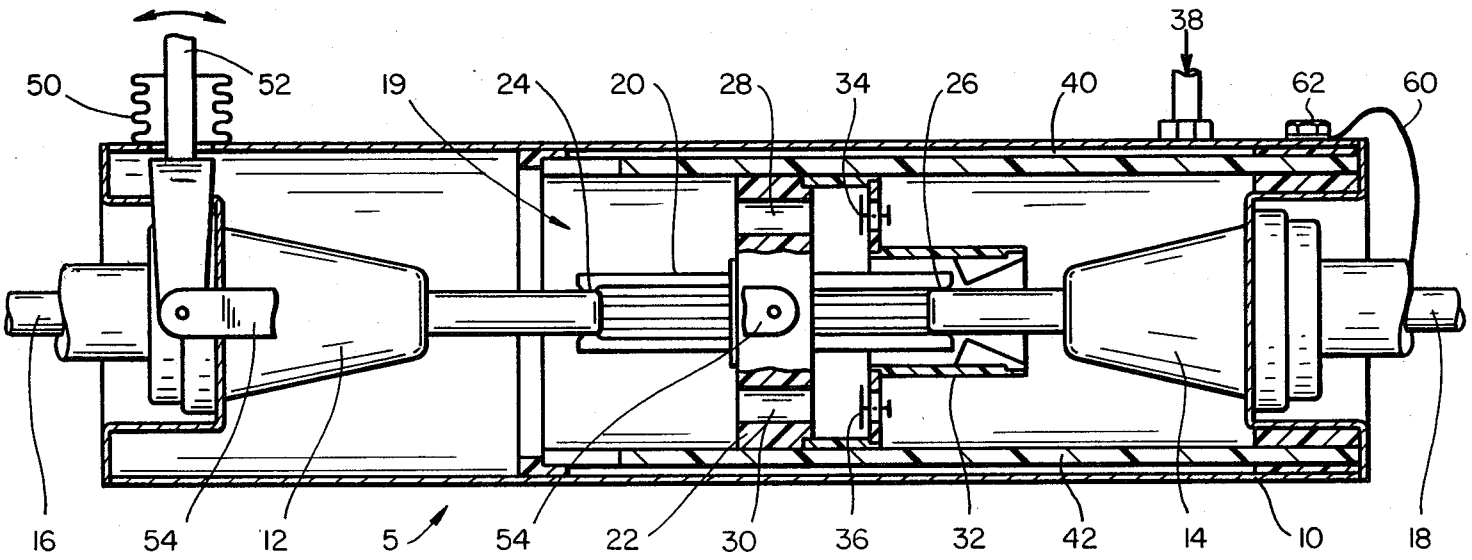
FIG. 7 illustrates another version of a switch according to the present invention.

A piston operating in a cylinder can guide the contact assembly in version of the invention in which a puffer or gas blasting mechanism is employed. A puffer mechanism provides a flow of insulating gas to the region where the arm forms to "blow out" the arc. In such versions, the body of the piston is relatively solid and is provided with appropriately positioned holes extending through the piston to direct a flow of insulating gas to the gap between the contacts so as to quench the arc formed as the contact assembly is moved. A puffer mechanism used in an embodiment of this invention is illustrated in FIG. 7 discussed in more detail below.

It is preferred to insert a solid tubular member or liner of an appropriate insulating medium or material between the contact assembly and the housing in the vicinity of the arcing zone. The tubular member preferably is positioned adjacent the wall of the housing and if desired can be bonded thereto. If the tubular member is bonded to the metal wall, the interface between the two components should be void free. It is preferred to position the tubular member such that there is an annular gap between the member and the wall. The tubular member can extend the entire length of the housing, if desired. The thickness of the insulating material depends, to a certain extent, on the voltage use of the switch. In general the tubular member should be from about 0.1 inch (2.5 mm) to about 0.5 inch (13 mm) thick. The tubular member is preferably of an acrylic, epoxy, or similar plastic. The tubular member can serve as a cylinder for guiding the piston of the contact assembly.

The switch can be equipped with electrodes for capacitive detection at relatively low voltage both high voltage energization of the switch conductors and the open or closed position of the contacts. This is possible with the tubular insulating liner positioned coaxially within the housing separated therefrom by a small gap or annular space for capacitive division of alternating current voltages of the conductors. The insulating liner can have conductive bands deposited in contact with the annular space, axially positioned proximate to each coaxial contact. The conductive bands can be connected to hermetically sealed terminals on the housing. Voltage measurements of the terminals can be made locally or remotely, the measurements corresponding to the contact voltages when the switch is connected in a distribution system.

For example, if the housing is approximately three inches (76 mm) in diameter, the conductive bands are approximately 2.9 inches (74 mm) in diameter and the contacts are approximately 0.5 inches (13 mm) in diameter, a voltage of approximately 225 volts being coupled to the corresponding conductive band; therefore, the presence of a high voltage at either contact can be detected by conventional equipment connected to the corresponding terminals. Should the voltages measured at the terminals indicate that one contact is energized while the other is not, a further indication of the contact assembly being in the open position is provided.

In case the contacts are shown by these measurements to be in the same condition (both energized or both unenergized) a high frequency current source can be connected to one of the terminals to determine the position of the contact assembly. The high frequency excitation of one conductive band is coupled to the corresponding conductor, through the contact assembly to the other conductor, thence to the other conductive band where it can be measured by a conventional frequency discriminating voltmeter. When the contacts are in the closed position, the transfer of excitation from one conductor to the other is direct; however, when the contacts are in the open position the resulting very low series capacitance between the conductors prevents significant high frequency excitation from being passed to the other conductor thence to the other conductive band. The degree of high frequency coupling can be measured under controlled operating conditions for calibration of the measurements. These measurements are meaningful in the switch of the present invention because the capacitance between the contacts is relatively low compared to the capacitance between the conductive bands and the respective contacts.

The switch is provided with means for moving the contact assembly from its first position to its second position. A preferred means comprises a rocking bellows or diaphragm mechanism positioned on the side wall towards one end of the housing. Operation of a lever or arm extending through the bellows results in moving the contact assembly from its first to its second position and back again as desired. Operation of the arm deflects the bellows by lateral and/or pivoting motion in a direction substantially normal to the axis of expansion of the bellows. This mode of deflection of the bellows is referred to herein as "rocking".

The use of bellows having rocking mode deflection in the high voltage switch of this invention provides several advantages. The rocking bellows can be operated without substantially changing the volume enclosed by the bellows as the contact assembly moves from its first position to its second position. This eliminates work which otherwise would be done compressing the insulating gas by conventional axial movement of the bellows. The rocking bellows enables the bellows to be located off the center line axis and thereby permits the unimpeded linear orientation of the conductors. Such linear orientation of the conductors, made possible by the use of a rocking belows in this manner, permits the switch to be readily installed as discussed more fully below. Further, the linear orientation of the conducting path within the switch assembly advantageously affects the magnitude and direction of magentic forces arising from a short circuit. The metal enclosure provides useful shielding tending to reduce the magnetic forces resulting from external current loops under short circuit conditions.

The use of a rocking bellows adds to the long life of the switch since there are no gas leak paths that would be present if O-ring or sliding seals were used.

Use of the rocking bellows reduces the size and cost of the bellows required, that is, the number of convolutions required of the bellows and also the life of the bellows is also improved because its actuating velocity is reduced, that is, only the relatively small velocities near the pivot are imparted to the bellows and not the high contact velocity. Since the stresses in the bellows are directly related to the velocity to which it is operated at high speeds, this innovation reduces stresses and increases the life and reliability of the device.

The compact size and light weight of a switch according to this invention enables it to be readily inserted into a distribution network. The switch can be connected directly into a power cable, for example by a conventional splice or by conventional separable joints or connectors. Such separable joints and connectors are typically of a molded elastomeric material adapted to receive, for example, a power cable and bushing to form an electrical connection between them. The relative ease with which the switch can be inserted in the distribution network is illustrated by the fact that the switch can be attached directly to a transformer by means of an elbow connector. Elbow connectors are commercially available and an example of a typical elbow connector can be found in U.S. Pat. No. 3,559,141 to Hardy.

Referring now to FIGS. 1–5, there is illustrated a preferred version of a switch 205 according to this invention. The switch 205 includes a metal, cylindrical housing 210 at ground potential. A supply bushing 212 and a load bushing 214 are mounted at opposite ends of the housing. The bushings 212 and 214 each have a ring 215 molded in place. The rings 215 are welded to the housing 210 to form a hermetic seal between the supply bushing 212, the load bushing 214 and the housing 210. A supply current rod 216 extends through the supply bushing 212 and a load current rod 218 extends through the load bushing 214. The current rods 216 and 218 each have a threaded hole 211 for engaging a fitting (not shown) or for use as a solder cup to join a power cable 217 of an external distribution network.

With reference to FIGS. 2, 3, and 4, a contact assembly 219 is axially slidably mounted within the housing 210. The contact assembly 219 comprises a plurality of cylindrically disposed contact rods 220 mounted concentrically within a piston 222. When the piston 222 is in a closed position (a) a first end 221 of the contact rods 220 engages an arcing contact 226, which is fastened to the load current rod 218. The contact rods 220 disengage from the arcing contact 226 when the piston is in an open position (b). In the drawings, the parts are shown in the closed position by solid lines; the open position is shown by phantom lines. A second end 227 of the contact rods 220 is at all times slidably engaged with a transfer contact 224, which is fastened to the supply current rod 216 within a counterbore 228 in the supply bushing 212. The counterbore 228 permits the combination of the contact 224 and the supply bushing 212 within the housing 210 to be made shorter for improved heat conduction while maintaining a sufficiently great surface distance over the supply bushing 212 to prevent arcing from the transfer contact 224 to ground potential. The piston 222 is provided with a plurality of axial holes 230 therethrough, to accommodate flow of insulating gas produced by the displacement of the gas by motion of the piston 222 between the first and second positions. A piston cup 231 is fastened to the outside of the piston 222 and holds a nozzle 232 surround the arcing contact 226 when the piston is in the first position. The piston cup 231 has a plurality of axial holes 233 all covered by a check valve 234 to control the flow of gas as described below. The check valve 234 is retained by a valve pin 235.

A blast shield 238 is located on the load current rod 218 and held in place by a retaining ring 240. The blast shield 238 is concave toward the arcing contact 226 for protecting the load bushing 214 from arcing.

An insulating liner 242 surrounding the contact assembly 219 is radially centered within the housing 210 by an O-ring 244 proximate to the supply bushing 212 to provide an annular space 245 between the housing 210 and the insulating liner 242. The piston cup 231 with the piston 222 is guided by the inside of the insulating liner 242.

The contact rods 220 are aligned to the piston 222 by a pair of finger washers 246, which are centered in counterbores 247 on opposite sides of the piston. Each of the contact rods 220 is biased inwardly by a leaf spring 248. Each of the contact rods 220 and leaf springs 248 have notches 249 to engage a slot 250 in the finger washers 246.

A sleeve spacer 252 is clamped to a threaded spacer 254 by a screw 256. The spacers 252 and 254 are axially located by engagement of the finger washers 246 with the spacers 252 and 254 within a cylinder 251 formed by the contact rods 220.

The main purpose of the sleeve spacer 252 is to control the contact force between the contact rods 220 and the transfer contact 224 when the contact rods 220 are disengaged from the arcing contact 226. When the contact rods disengage from the arcing contact, the contact rods are driven against the sleeve spacer 252 by the leaf springs 248. The shift in the axial position of the reaction force against the contact rods from the arcing contact 226 to the sleeve spacer 252 results in reduction in the force of the contact rods on the transfer contact 224, thereby reducing the magnetude of the contact force at the transfer contact when the contact rods 220 are disengaged from the arcing contact 226. The amount of this outward bias depends on the length of the sleeve spacer 252. A relief 257 is provided in each contact rod 220 localizing the pressure on the transfer contact 224 at the end 227 of the contact rod 220. It is acceptable to tolerate a much lower contact force on the transfer contact 224, because heating is not a problem within the very short time interval that is required to move the contacts from their open to closed position, i.e. a matter of 10 to 20 milliseconds. Another purpose of the spacers 252 and 254 is to retain the contact rods 220 and the leaf springs 248 within the slots 250 to facilitate handling of the contact assembly 219 prior to final assembly within the housing 210.

Preferably clearance is provided between the sleeve spacer 252 and the contact rods 220, the clearance being sufficient to allow for some misalignment of the arcing contact 226 with the contact assembly 219 and for normal erosion of the contacts.

The piston 222 is driven from the open position (a) to the closed position (b) by a pair of links 258, which are pivotably connected to the piston by a pair of piston pins 259. The piston pins 259 can also serve to fasten the piston cup 231 to the piston 222.

Preferably the piston 222, the cup 231, the links 258 and the piston pins 259 are all made of an insulating material. By avoiding the use of unnecessary conducting materials in the vicinity of the contact assembly 219, the grounded housing 210 can be smaller in diameter without being subjected to arcing. Conductive materials within the contact assembly 219 are arranged within a diameter approximating the diameter of the supply bushing 212 and the load bushing 214 resulting in a nearly optimum ratio of energized to grounded coaxial diameters for reducing the maximum electric field strength within the housing 210. In addition, the use of only insulating materials where there is sliding contact, especially between the piston cup 231 and the insulating liner 242, avoids contamination of the insulating gas within the switch 205 by conductive wear particles.

Figure 6:
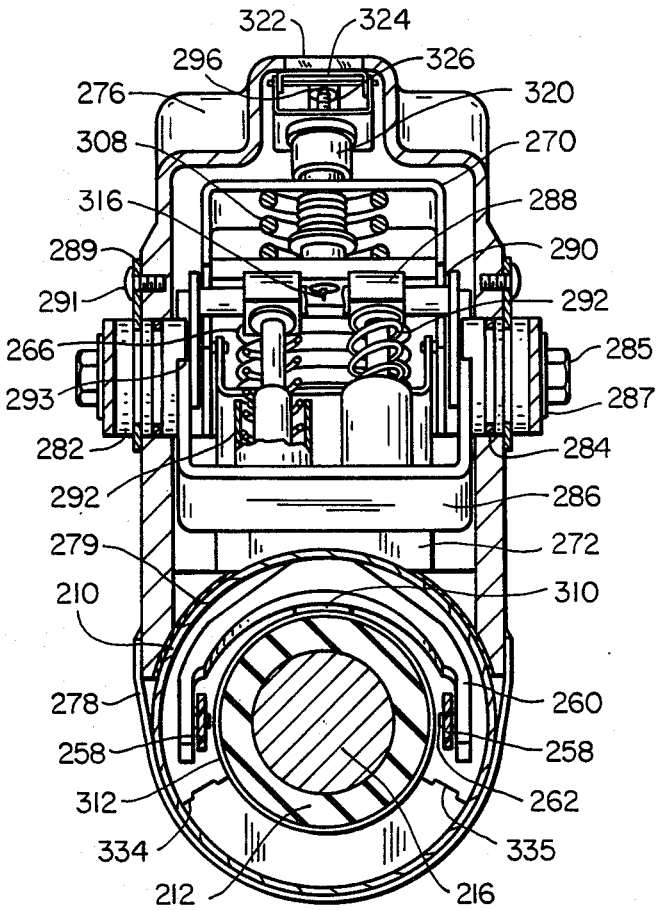
FIG. 6 is a lateral sectional view of the switch of FIG. 1 taken on line 6—6 in FIG. 5.
Figure 5:
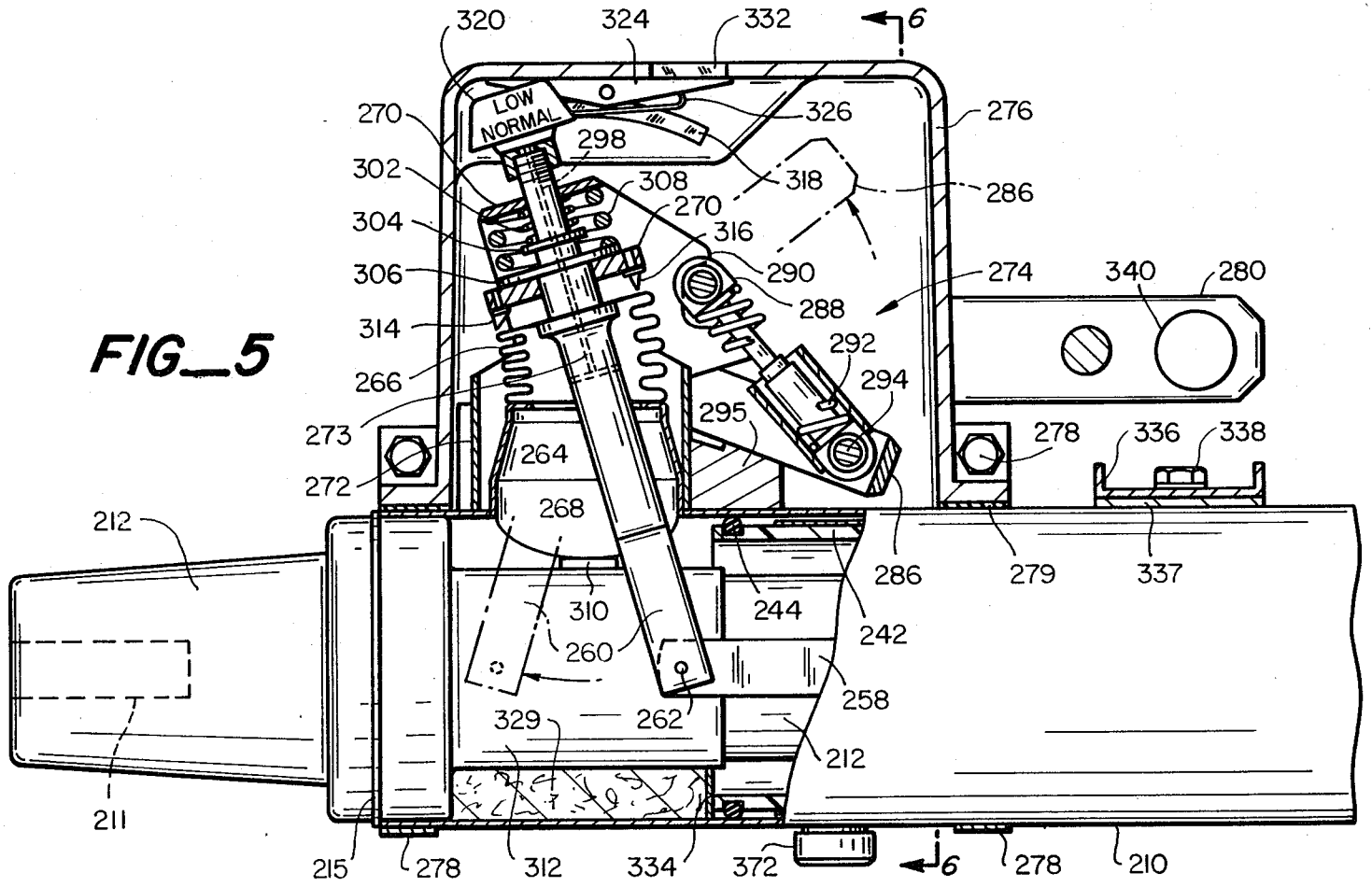
FIG. 5 is a detailed vertical sectional view of the actuator of the switch of FIG. 1, the actuator including a water-tight cover.

With reference to FIGS. 5 and 6, the links 258 are connected to a yoke 260 by a pair of yoke pins 262. A crank or actuating arm 264 is welded to the yoke 260 and extends through a rocking bellows 266, the bellows 266 being soldered to the arm 264 to form a hermetic seal. The bellows 266 is soldered to a bellows support 268, which is welded to the housing 210. The arm 264 slidably engages a bridge rocker 270, which is pivotably mounted to a rocker stand 272 welded to the housing 210. The pivotable mounting of the bridge rocker 270 to the rocker stand 272 forms a fulcrum 273 for the arm 264. The fulcrum 273 passes through the rocking bellows 266 for sufficient freedom of the arm 264 with only slight strain of the rocking bellows 256. Rotation of the crank through an angle of about 32 degrees results in movement of the piston 222 by the links 258 between the closed position (a) and the open position (b).

An overcenter mechanism 274 is used to pivot the bridge rocker 270 to operate the arm 264. The overcenter mechanism 274 can be enclosed within a water-tight cover 276 fastened to the housing 210 by a pair of conventional clamps 278 with a gasket 279 between the cover 276 and the housing 210. A conventional handle 280 straddles the cover 276 and is coupled to the overcenter mechanism 274 through the cover 276 by a pair of coupling shafts 282 equipped with O-ring seals 284. The gasket 279 and the O-ring seals 284 exclude water and foreign matter from the interior of the cover 276 which is maintained nominally at atmospheric pressure.

The coupling shafts 282 are each fastened to a slot 283 in the handle 280 by a screw 285 and a washer 287. Each of the coupline shafts 282 is held in axial alignment by a coupling retainer 289 fastened to the cover 276 by a screw 291.

The overcenter mechanism 274 comprises a U-shaped detent arm 286 pivotably mounted to the rocker stand 274 in line with and driven by a slot 293 in each of the coupling shafts 282. A striker 288 is pivotably mounted to the rocker stand 272, engaging slots 290 in the bridge rocker 270 and biased by an overcenter spring 292 away from a detent shaft 294, which is fixed to the detent arm 286. The travel of the detent arm 286 and the bridge rocker 270 is limited by a detent stop 295, which is fastened to the rocker stand 272.

In some applications of the switch 205, the water-tight cover 276 enclosing the overcenter mechanism 274 need not be provided. In that case, the handle 280 can be adapted to be fastened directly to the detent arm 286 as shown in FIG. 1.

Sulfur hexafluoride, or other insulating gas, is introduced into the switch 205, with the cover 276 removed, through an extension 296 and inlet passage 298 in the crank 264. After the introduction of the desired amount of gas to the switch 205, a hermetic seal is generated by bending the extension 296 to produce a fold 300.

The arm 264 is biased toward the interior of the housing 210 by a low pressure spring 302 acting through a spring washer 304. The elevated pressure within the switch biases the rocking bellows 266 away from the housing 210, compressing the low pressure spring 302 until the arm 264 engages a stop washer 306, which is biased against the bridge rocker 270 by a high pressure spring 308. If a leak develops in the switch, the low pressure spring 302 overcomes the reduced pressure within the rocking bellows 266 to displace the arm 264 toward the supply bushing 212. In that event, the arm 264 is in a locked inoperative position and the piston 222 is locked into either the first or second position by a stop 310 engaging the yoke 260. The stop 310 is fixably mounted to a collar 312 welded to the housing 210, the collar 312 surrounding the supply bushing 212. Normal pressure within the housing 210 causes the yoke 260 to be positioned away from the stop 310 to permit operation of the piston 222 between the first and second positions.

In the event that an abnormally high pressure develops within the housing 210, the outward biase of the rocking bellows 266 overcomes the high pressure spring 308 and the stop washer 306 is forced away from the bridge rocker 270. This causes the rocking bellows 266 to be punctured by a blade 314 and/or a point 316 fixed to the bridge rocker 270. This safety feature prevents an explosion of the switch, should there be an abnormal generation of gas within the switch. Should the rocking bellows 266 become punctured by the blade 314 and/or the point 316, the resulting low pressure condition causes the piston 222 and arm 264 to become locked as before described.

A side window 318 is provided in the cover 276 for visual indication of the pressure within the housing 210. A cap 320 mounted on the arm 264 has colored low and normal indications visible one at a time through the side window 318. When the proper pressure level exists within the housing 210, the "normal" indication is visible through the side window; when a low pressure condition allows the crank to be depressed to lock the yoke by the stop 310 the "low" indication is visible through the side window. If the rocking bellows 266 becomes punctured by the blade 314 or the point 316 as a result of an abnormally high pressure within the switch, the stop 310 becomes engaged by the yoke 260 as a result of the ensuing low pressure condition and the "low" indication will be visible through the side window.

A visual indication of the position of the contact assembly 219 is provided through a top window 322 in the cover 276. A position indicator 324 having appropriate "open" and "closed" labels is connected to the cap 320 and biased against the top window by a clip 326.

A molecular sieve 328 is retained within a holder 330 by a screen 332. The insulating liner 242 holds the screen in place to retain the molecular sieve with the holder against the load bushing 214. The small size of the switch 205 results in a high ratio of surface area to volume within the housing 210; therefore, a substantial concentration of undesirable moisture from the internal surfaces can be present after the switch 205 is sealed. The molecular sieve 328 attracts moisture from within the housing 210 and gas contaminates generated by wear and/or arcing within the switch. The insulating liner 242 is held against the screen by a liner stop 334, which is fastened to the collar 312. An auxilliary molecular sieve 329 can be retained under the collar 312 by a pair of tabs 335 on the liner stop 334.

A bracket 334 is welded to the housing to permit the switch 205 to be located by a channel 336 fastened to the bracket 334 by a pair of screws 338. The channel 336 can be used to support the switch 205 and/or locate additional switches according to this invention parallel to the switch 205, for exaple, to form an assembly of three single-phase switches. A bar 340 extending through the handles 280 of the switches 205 can operate each of the switches simultaneously to disconnect the phases in a 3-phase configuration. The screws 338 can be used to electrically connect the housing 210 to ground. A shield lead 342 from each of the power cables 217 is clamped under a corresponding screw 338.

The switch 205 is equipped with electrodes for capacitive detection at relatively low voltage both high voltage energization of the switch conductors and the open or closed position of the contacts. The insulating liner has a first conductive band 350 and a second conductive band 352 deposited in contact with the annular space 245 axially positioned proximate to the arcing contact 226 and the transfer contact 224 respectively. On the conductive bands 350 and 352 are soldered corresponding first and second spring clips 354 and 356 engaging first and second teminals 358 and 360. The first and second terminals 358 and 360 are insulatingly hermetically sealed within respective first and second nipples 362 and 364 by corresponding first and second bushing plugs 366 and 368. The first and second nipples 362 and 364 protrude the housing 210 and are hermetically fastened thereto with solder. First and second threaded caps 370 and 372 engaging respective first and second nipples 366 and 368 can be provided for protecting the terminals 358 and 360 when not in use.

Whether used singly or in combination the switch 305 is sufficiently light and compact to be supported by the power cables 217 connected to the supply current rod 216 and the load current rod 218, if desired.

In operation, movement of the handle 280 away from the housing 210 causes the detent arm to rotate, compressing the overcenter spring 292 until the detent arm 286 is in line with the striker 288. Continued operation of the handle results in rapid rotation of the bridge rocker 270 by the striker 288 to generate a snap action of the piston 222 and the contact assembly 219 from (a) the closed position to (b) the open position regardless of the speed of operation of the handle 280. Conversely, movement of the handle 280 toward the housing 210 causes the piston 222 and the contact assembly 219 to snap from (b) the open position to (a) the closed position regardless of the speed of operation of the handle 280.

When the contact assembly 219 snaps from (a) the closed position to (b) the open position, the ends 221 of the contact rods 220 are displaced from contact from the arcing contact 226. This results in an arc being drawn between the contact rods 220 and the arcing contact 226 when a load current is present in the switch 205. The rapid motion of the piston 222 generates a flow of insulating gas through the holes 230 in the piston 222, the gas being directed around the first ends 221 of the contact rods 220 and through the nozzle 232 to quench the arc. The flow of gas increases the pressure within the piston cup 231, holding the check valve 234 closed against the piston cup confining all gas flow to the nozzle 232.

The increased pressure within the piston cup 231 caused by the flow of insulating gas through the nozzle 232 tends to stabilize the velocity of the contact assembly 219 to assure a continued flow of insulating gas through the nozzle 232 during a current reversal following separation of the contact rods 220 from the arcing contact 226 a distance sufficiently great to preclude arc regeneration. The volume of insulating gas downstream of the nozzle 232 within the housing 210, including the volume of the annular space 245, being larger than the remaining volume of insulating gas within the housing 210, provides for expansion of insulating gas having been heated by the arc without excessively increasing back pressure at the nozzle.

The equalization of gas pressure within the housing 210 downstream of the nozzle 232 and within the annular space 245 causes some flow of insulating gas through the molecular sieve 328. Wear particles and vaporization products present in the insulating gas are directed toward the molecular sieve 328 where they are trapped as a result of gas flow through the molecular sieve 328 and because of the attracting properties of the molecular sieve 328. Additional wear particles and vaporization products are attracted to the auxilliary molecular sieve 329.

When the switch 205 is operated to connect a load by movement of the contact assembly 219 from (b) the second position to (a) the first position, the check valve 234 opens by sliding on the valve pins 235 away from the holes 233 in the piston cup 231, thereby relieving pressure in front of the advancing piston cup 231 to allow a more rapid snap movement of the contact assembly 219 from (b) the second position to (a) the first position for preventing arcing as the first ends 221 of the contact fingers 220 engage the arcing contact 226.

When the arcing contact 226 or the transfer contact 224 are energized with an alternating current voltage, a corresponding voltage can be measured at the corresponding first or second terminals 358 or 360. A voltage of 15 kV at either the arcing contact 226 or the transfer contact 224 results in a voltage of approximately 225 volts being coupled to the corresponding first or second conductive band 350 or 352, thus the presence of a high voltage at either contact can be detected by conventional equipment connected to the corresponding terminals 358 and 360. Should the voltages measured at the first and second terminals 358 and 360 indicate that one contact is energized while the other is not, a further indication of the contact assembly 219 being in the open position is provided.

In case the arcing contact 226 and the transfer contact 224 are shown by these measurements to be in the same condition (both energized or both unenergized) a high frequency current source can be connected to one of the first or second terminals 358 or 360 to determine the position of the contact assembly 219 as described above.

Referring now to FIG. 7, there is illustrated another embodiment of the switch of this invention. The switch 5 includes a ground enclosure 10 which is a cylindrical metal housing. The thickness of the housing in the illustrated embodiment is 1/32 inch (0.8 mm). Bushings 12 and 14 are mounted at opposite ends of the enclosure. Current conducting rods 16 and 18 extend through bushings 12 and 14 respectively. The portion of each bushing extending from the external side of the bushing is readily connectable to components of a distribution network such as a cable or transformer by splicing or through a push-on elbow connector as described in more detail below. The portions of the conductor of the bushing extending into the interior of the switch are adapted to make contact with assembly, 19, contact assembly comprising an axially slotted cylindrical metal tube 20 and piston 22. In a first position the contact assembly contacts each of the conducting rods 16 and 18 at transfer contact 24 and arcing contact 26. The piston 22 is provided with several holes two of which are shown as holes 28 and 30 extending therethrough to accomodate flow of insulating gas produced by the displacement of the gas by the downward motion of the piston in the enclosure 10. To the piston 22 on the same side of the disk as the arcing contact 26 is attached a nozzle 32. The nozzle structure 32 contains check valves 34 and 36 to control the flow of gas as described below.

The switch 5 is also equipped with an inlet valve 38 for introduction of sulfur hexafluoride, or other insulating gas, into the switch. The sulfur hexafluoride fills the body of the switch 5 including gap 40 between ground enclosure 10 and an insulating liner 42. The insulating liner 42 can be made from a solid dielectric or other suitable insulating medium.

The ground enclosure 10 is provided with rocking bellows 50 through which crank 52 extends substantially radially into the body of the switch. The bellows permits movement of the crank 52 while maintaining the hermetic seal of the enclosure. The crank is forked to envelope the bushing well which is at ground potential. A pair of diametrically opposite linkages, 52 (partially shown) is connected to piston 22. To operate the switch an external actuator (not shown) is connected to the end of crank 52. On operation of the actuator downward motion of crank 52 acts on the linkages 54 to move piston 22 downward. As the piston 22 is integral with the rest of the contact assembly 20, the entire contact assembly 20 moves downward. Transfer contact 24 slides down conductor 16 and arcing contact 26 moves away from conductor 18 creating a gap across which an arc is drawn. This motion of the piston 22 causes a flow of insulating gas through holes 28 and 30 while it closes check valves 34. The insulating gas is forced through the nozzle assembly 32 which by virtue of its shape causes gas to flow substantially axially along the gap thereby extinguishing the arc drawn between arcing contact 26 and conductor 18.

The external ends of conductors 16 and 18 can be electrically connected into the distribution network by any convenient manner. When the switch 5 is inserted into an electrical circuit the ground enclosure 10 is grounded by any conventional technique. In FIG. 7 ground wire 60 is connected to enclosure 10 by means of nut 62.

The switch of this invention can be connected into an electrical network between a load and a power source by conventional means. For example, conductors 16 and 18 can be spliced to power cables, connected to electrical equipment such as transformers or motors, interconnected with other electrical components such as fuses or the like (in particular, shielded fuses such as those disclosed in application Ser. No. 400,509 assigned to the same assignee as the instant application), with other switches of this type for example, as described below and numerous other possibilities. It is a major advantage of the switch of this invention that it is so readily connected to other electrical components of a distribution power system. A convenient way of connecting the switch to other electrical equipment is by means of an elbow connector. Molded elastomeric elbow shaped connectors are equipped typically with a bushing well to be joined to a bushing of electrical equipment by a push fit and a second well adapted to receive a power cable or the bushing of another electrical component.

Figure 8:
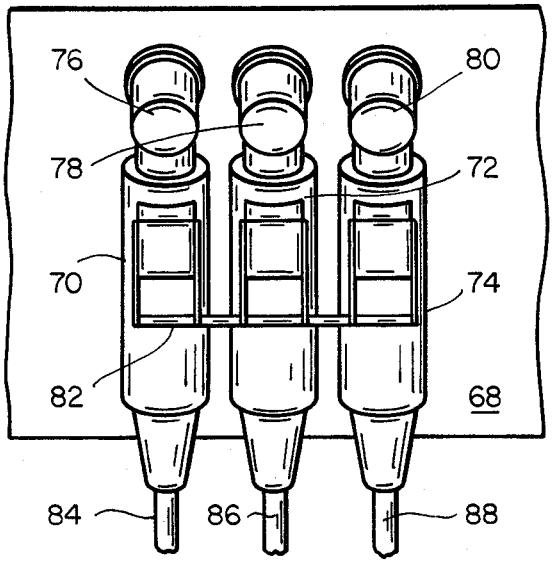
FIG. 8 illustrates the connection in a three phase system of three single phase switches of the version of FIG. 7 to the bushings of a transformer using elbow connectors.

FIG. 8 shows three single phase switches of this invention electrically connected to the bushings of a three phase transformer. In FIG. 8, switches 70, 72 and 74 are connected by elbow connectors 76, 78 and 80 respectively to bushings of a transformer 82. The switches are interconnected by mechanism 82 so that on actuation, the three switches operate simultaneously. The other end of the switches 70, 72 and 74 are connected to cables 84, 86 and 88 respectively by convenient means (not shown) such as "push on" separable joints conventional splices or the like.

Figure 9:
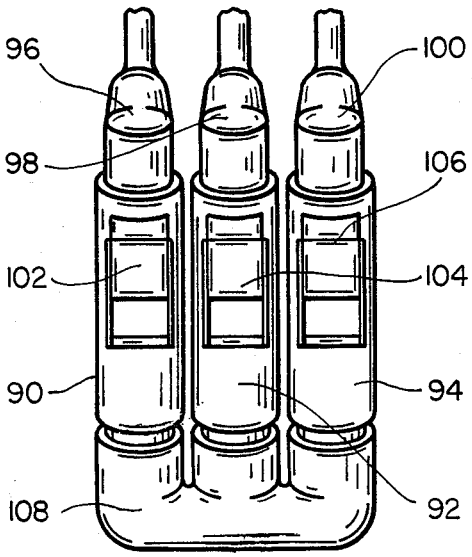
FIG. 9 illustrates an arrangement of three switches of the version of FIG. 7 in a single phase loop feed configuration in which each switch is operated independently of the others.

FIG. 9 shows three single phase switches of the same phase connected together in a loop feed system. Switches 90, 92 and 94 are shown connected to elbow connectors 96, 98 and 100 respectively. As the switches are connected in a loop feed system the switches are actuated independently through cranks 102, 104 and 106 respectively. The switches are connected in a loop feed arrangement in enclosure 108.

Although the present invention has been described in consideration detail with reference to certain preferred versions thereof, other versions are possible. For example, a single bridge rocker connected to only one over center mechanism can be extended to operate simultaneously the cranks of the switches in a 3-phase assembly. Further, another version can include a stationary bulkhead near the transfer contact restricting the flow of insulating gas ahead of the advancing piston for increasing flow through the nozzle without a material reduction of the volume of insulating gas in the housing. Therefore, the spirit and scope of the appended claims should not necessarily be limited to the description of the versions contained herein.

What is claimed is:

1. A switch comprising:

(a) a housing;

(b) first and second opposed conductors in the housing;

(c) a contact assembly between the conductors movable between a first closed position in electrical contact with both conductors and a second open position in contact with only the second conductor, the assembly comprising:

(i) a plurality of electrically conducting rods arranged in a cylindrical configuration around the conductors, the rods being in sliding contact with the second conductor and, only when proximate to the closed position, in sliding contact with the first conductor; and (ii) biasing means for exerting an inwardly directed force on the rods toward both conductors, the force being at a first level when the contact assembly is in the first closed position and at a second level when the contact assembly is not in contact with the first conductor, the first level being greater than the second level.

2. The switch of claim 1 wherein the housing is permanently hermetically sealed and containing an insulating gas at a pressure of greater than 2 atmospheres absolute, the switch further comprising;

(a) an actuating arm protruding through the housing and movable between first and second positions;

(b) a bellows hermetically sealed to the arm and to the housing, the bellows deflecting in rocking mode when the arm is moved between the first and second position; and (c) means connecting the arm to the contact assembly so that by moving the arm between its first and second position the contact assembly is correspondingly moved between the closed position and the open position.

3. The switch of claim 2 in which the housing has opposed ends and a cylindrical side and the first and second conductors are coaxially located at opposite ends of the housing, and wherein the arm and the bellows are located at the cylindrical side of the housing.

4. The switch of claim 3 in which the arm is pivotally mounted.

5. The switch of claim 1 in which the housing has opposed ends and a side and the conductors are at opposite ends of the housing, and wherein the switch includes (a) an actuating arm protruding through the side of the housing and pivotable with respect thereto between first and second positions, and (b) means connecting the arm to the contact assembly so that by moving the arm between its first and second positions the contact assembly correspondingly moves between the closed position and the open position.

6. The switch of claim 1 further comprising:

(a) fill means for introducing insulating gas into the housing; and (b) hermetic means for sealing the housing and the fill means.

7. The switch of claim 6 including a molecular sieve for removing any moisture within the housing.

8. The switch of claim 1 mounted in a circuit of from about 1 to about 36 kV and capable of continuously carrying and interrupting at least 100 amperes, the housing being at ground potential and being cylindrical with a diameter of less than about 6 inches (150 mm).

9. The switch of claim 8 in a circuit of at least 10 kV.

10. The switch of claim 1 in which the housing is cylindrical, and the contact assembly further comprises means adapted to function as a piston axially movable in the cylindrical housing.

11. The switch of claim 10 including an insulating gas within the housing and a nozzle on the contact assembly for directing the insulating gas to the conducting rods and the first conductor, and wherein the contact assembly pumps insulating gas through the nozzle onto the first conductor as the contact assembly moves from the closed position to the open position, the switch further comprising:

(a) an insulating liner within and spaced apart from the housing with an annular space between the liner and the housing, the insulating liner serving as a cylinder for the contact assembly; and (b) sealing means in the annular space between the liner and the housing, the sealing means separating the housing into first and second sections proximate to the first and second sections proximate to the first and second conductors respectively, the first section including the annular space, the first section being larger than the second section so that the first sections holds more insulating gas than the second section.

12. The switch of claim 10 including an insulating liner within the housing, the insulating liner serving as a cylinder for the contact assembly.

13. The switch of claim 10 permanently hermetically sealed and containing an insulating gas at a pressure greater than 2 atmospheres.

14. The switch of claim 1 mounted in a circuit of at least 1 kV, and wherein the housing is conductive, grounded, cylindrical and coaxial with the first and second conductors and wherein the switch includes first and second conductive bands coaxially positioned between the respective first and second conductors and the grounded housing.

15. The switch of claim 14 including a cylindrical insulating liner within and spaced apart from the housing with an annular space between the liner and the housing, wherein the contact assembly further comprises means adapted to function as a piston axially movable in the cylindrical insulating liner, and wherein the conductive bands are formed on the insulating liner.

16. The switch of claim 1 in which the biasing means comprises leaf springs having opposed first and second ends, the first end pressing the rods toward the first conductor and the second ends pressing the rods toward the second conductor when the contact assembly is in the closed position, the force on the first conductor at the second level being substantially zero.

17. A switch mounted in a circuit of at least 1 kV, the switch comprising:

(a) a cylindrical conductive grounded housing;

(b) first and second opposed conductors coaxially located in the housing;

(c) a contact means for opening and closing the circuit between the first and second opposed conductors; and (d) first and second conductive bands coaxially positioned between the respective first and second conductors and the grounded housing.

18. A switch comprising:

(a) a permanently hermetically sealed metal housing containing an insulating gas at a pressure greater than 2 atmospheres absolute;

(b) first and second opposed conductors in the housing;

(c) a contact assembly having a first conducting position and a second non-conducting position;

(d) an actuating arm protruding through the housing and movable between first and second positions;

(e) a bellows consisting essentially of metal and hermetically sealed directly to the arm and to the housing, the bellows deflecting in rocking mode when the arm is moved between the first and second position; and (f) means connecting the arm to the contact assembly so that by moving the arm between its first and second position the contact assembly is correspondingly moved between the closed position and the open position.

19. The switch of claim 18 wherein the arm is pivotably mounted.

20. The switch of claim 18 mounted in a circuit of from about 1 to about 36 kV and capable of continuously carrying and interrupting at least 100 amperes, the housing being at ground potential and being cylindrical with a diameter of less than about 6 inches (150 mm).

21. The switch of claim 18 in which the housing has opposite ends and a cylindrical side and the first and second conductors are coaxially located at opposite ends of the housing, and wherein the bellows and arm are located at the cylindrical side of the housing.

22. The switch of claim 21 mounted in a circuit of from about 1 to about 36 kV and capable of continuously carrying and interrupting at least 100 amperes, the housing being at ground potential and being cylindrical with a diameter of less than about 6 inches (150 mm).

23. A switch comprising:

(a) a cylindrical, metallic, conducting, grounded permanently sealed housing having opposite ends and a side;

(b) first and second opposed conductors at the ends of the housing;

(c) a contact assembly between the conductors movable between a first closed position in electrical contact with both conductors and a second open position not in contact with one of the conductors;

(d) an actuating arm protruding through the side of the housing and movable between first and second positions;

(e) a bellows consisting essentially of metal and hermetically sealed directly to the arm and to the housing, the bellows deflecting in rocking mode when the arm is moved between first and second positions;

(f) means connecting the arm to the contact assembly so that by moving the arm between its first and second position the contact assembly is correspondingly moved between the closed position and the open position; and (g) an insulating gas in the housing at a pressure greater than 2 atmospheres absolute.

24. A switch mounted in a circuit of from about 1 to about 36 kV and capable of continuously carrying and interrupting at least 100 amperes, the switch comprising:

(a) a grounded conductive cylindrical housing having opposite ends and a side and a diameter of less than about 6 inches (150 mm);

(b) first and second opposed conductors at opposite ends of the housing;

(c) a contact assembly between the conductors movable between a first closed position in electrical contact with both conductors and a second position in contact with only the second conductor, the assembly comprising;

(i) a plurality of electrically conducting rods arranged in a cylindrical configuration around the conductors, the rods being in sliding contact with the second conductor and, only when proximate to the closed position, in sliding contact with the first conductor;

(ii) biasing means for exerting an inwardly directed force on the rods toward both conductors, the force being at a first level when the contact assembly is in the first closed position at a second level when the contact assembly is not in contact with the first conductor, the first level being greater than the second level;

(d) an actuating arm protruding through the housing and movable between first and second positions;

(e) a bellows hermetically sealed to the arm and to the housing, the bellows deflecting in rocking mode when the arm is moved between the first and second position;

(f) means connecting the arm to the contact assembly so that by moving the arm between its first and second position the contact assembly is correspondingly moved between the closed position and the open position;

(g) an insulating gas within the housing;

(h) an insulating liner within and spaced apart from the housing, with an annular space between the liner and the housing, the insulating liner serving as a cylinder for guiding the contact assembly;

(i) sealing means in the annular space between the liner and the housing, the sealing means dividing the housing into first and second sections proximate to the first and second conductors respectively, the first section including the annular space, the first section being larger than the second section so that the first section holds more insulating gas than the second section;

(j) a nozzle on the contact assembly for directing the insulating gas to the conducting rods and the first conductor, wherein the contact assembly is adapted to function as a piston in the insulating liner and pumps the insulating gas through the nozzle onto the first conductor as the contact assembly moves from the closed position to the open position; and (k) first and second conductive bands on the insulating liner coaxially positioned between the respective first and second conductors and the grounded housing for measurement of voltages on the respective first and second conductors by capacitive division.

25. An assembly comprising:

(A) a plurality of switches, each switch comprising:

(a) a housing;

(b) first and second opposed conductors in the housing;

(c) a contact assembly between the conductors movable between a first closed position in electrical contact with both conductors and a second open position in contact with only the second conductor, the assembly comprising:

(i) a plurality of electrically conducting rods arranged in a cylindrical configuration around the conductors, the rods being in sliding contact with the second conductor and, only when proximate to the closed position, in sliding contact with the first conductor;

(ii) biasing means for exerting an inwardly directed force on the rods toward both conductors, the force being at a first level when the contact assembly is in the first closed position at a second level when the contact assembly is not in contact with the first conductor, the first level being greater than the second level;

(B) bracket means for mounting the switches positioned in parallel; and (C) actuator means connected to each switch for moving the respective contact assemblies in unison.

26. The assembly of claim 25 wherein each housing has opposed ends and a cylindrical side and the first and second conductors are coaxially located at opposite ends of the housing, and wherein each housing is conductive, grounded, permanently hermetically sealed and containing an insulating gas at a pressure of greater than 2 atmospheres absolute, each switch further comprising:

(a) an actuating arm protruding through the side of the housing and movable between first and second positions;

(b) a bellows hermetically sealed to the arm and to the side of the housing, the bellows deflecting in rocking mode when the arm is moved between the first and second position; and (c) means connecting the arm to the contact assembly so that by moving the arm between its first and second position the contact assembly is correspondingly moved between the closed position and the open position.

27. The assembly of claim 26 wherein each switch further comprises:

(a) an insulating liner within and spaced apart from the housing, with an annular space between the liner and the housing, the insulating liner serving as a cylinder for guiding the contact assembly;

(b) sealing means in the annular space between the liner and the housing, the sealing means dividing the housing into first and second sections proximate to the first and second conductors respectively, the first section including the annular space, the first section being larger than the second section so that the first section holds more insulating gas than the second section; and (c) a nozzle on the contact assembly for directing the insulating gas to the conducting rods and the first conductor, wherein the contact assembly is adapted to function as a piston in the insulating liner and pumps the insulating gas through the nozzle onto the first conductor as the contact assembly moves from the closed position to the open position.

28. The assembly of claim 25 directly connecting a plurality of first and second suspended cable portions of an electrical power system of from about 1 to about 36 kV and at least 100 amperes, wherein each housing has opposite ends and the first and second opposed conductors in each housing have terminations external to the respective ends of the housing connected in tension to the respective cable portions for supporting the assembly by the cable portions.

29. A single phase ground enclosed load break switch for use in electrical circuits in the voltage range of from about 1 to about 36 kilovolts which comprises:

(a) a sealed, grounded, cylindrical housing comprised substantially of metal having a diameter in the range of from about 2 to about 6 inches (50–150 mm);

(b) first and second bushing means mounted so as to penetrate said cylindrical metal housing, one of said bushings being mounted proximate one end of said housing and the other being mounted proximate the other end of said housing, each of said bushings having an electrical conductor therethrough;

(c) a contact assembly capable of assuming a first position in which it is in physical and electrical contact with the electrical conductor of each of said bushings and a second position in which it is physically and electrically separated from at least one of said conductors;

(d) means for causing said contact assembly to move from said first position to said second position, thereby causing said contact assembly to be separated from at least one of said conductors thus interrupting current flow through the switch and conversely from said second position to said first position, thereby causing said contact assembly to be in contact with each of said conductors thus providing a path for current flow through the switch;

(e) means for maintaining said contact assembly in alignment with the conductors of the bushings, said means comprising a piston extending from the contact assembly to the cylindrical housing; and (f) an insulating gas in said housing maintained at a pressure of up to about 5 atmospheres absolute; said switch being adapted to be electrically connected between a load and a power source having a voltage in the range of from about 1 to about 36 kilovolts.

30. A switch in accordance with claim 29 wherein said piston is made of an insulating material.

31. A switch in accordance with claim 29 wherein said piston has a relatively open structure for permitting insulating gas displaced by the piston to flow to the contact assembly.

32. A switch in accordance with claim 29 further comprising a tubular member of a solid dielectric positioned between said contact assembly and said cylindrical housing.

33. A switch in accordance with claim 32 wherein said tubular member is adjacent said housing.

34. A switch in accordance with claim 32 wherein said tubular member is bonded to said housing.

35. A switch in accordance with claim 32 wherein said tubular member extends substantially the entire length of said housing.

36. A switch in accordance with claim 29 wherein said insulating gas is sulfur hexafluoride.

37. A switch in accordance with claim 36 wherein said gas is at a pressure of at least 2 atmospheres absolute.

38. A single phase load break switch for use in electrical circuits in the voltage range of from about 1 to about 36 kilovolts which comprises:

(a) a sealed, grounded, cylindrical housing having a diameter in the range of from about 2 to about 6 inches (50–150 mm);

(b) first and second bushing means coaxially penetrating said cylindrical metal housing, one of said bushings being mounted proximate one end of said housing and the other being mounted proximate the other end of said housing, each of said bushings having an electrical conductor therethrough;

(c) a contact assembly capable of assuming a first position in which it is in physical and electrical contact with the electrical conductor of each of said bushings and a second position in which it is physically and electrically separated from at least one of said conductors;

(d) means for causing said contact assembly to move from said first position to said second position, thereby causing said contact assembly to be separated from at least one of said conductors thus interrupting current flow throiugh the switch and conversely from said second position to said first position, thereby causing said contact assembly to be in contact with each of said conductors thus providing a path for current flow through the switch;

(e) a piston of an insulating material extending from said contact assembly in assignment with the conductors of the bushings; and (f) an insulating gas in said housing maintained at a pressure of from about 1 to about 5 atmospheres absolute; said switch being adapted to be electrically connected into an electrical power distribution system having a voltage in the range of from about 1 to about 36 kilovolts.

39. An assembly comprising a three phase distribution system each phase thereof being provided with a single phase switch in accordance with claim 38.

40. The assembly of claim 39 wherein the insulating gas is sulfur hexafluoride at a pressure of at least 2 atmospheres absolute.

41. The assembly of claim 40 wherein each switch further comprises a tubular member of a solid dielectric between the contact assembly and the cylindrical housing for guiding the piston.

42. An assembly in accordance with claim 39 which further comprises a metal housing surrounding said switches, said housing containing an insulating gas maintained at a pressure of about 1 atmosphere.

43. A single phase ground enclosed load break switch for use in electrical circuits in the voltage range of from about 1 to about 36 kilovolts which comprises:

(a) a sealed cylindrical housing comprises substantially of metal having a diameter in the range of from about 2 to about 6 inches (50–150 mm);

(b) first and second bushing means mounted so as to penetrate said cylindrical metal housing, one of said bushings being mounted proximate one end of said housing and the other being mounted proximate the other end of said housing, each of said bushings having an electrical conductor therethrough;

(c) a contact assembly capable of assuming a first position in which it is in physical and electrical contact with the electrical conductor of each of said bushings and a second position in which it is physically and electrically separated from at least one of said conductors;

(d) means for causing said contact assembly to move from said first portion to said second position, thereby causing said contact assembly to move out of electrical contact with one of said conductors and conversely from said second position to said first position, thereby causing said contact assembly to move into electrical contact with each of said conductors;

(e) an insulating gas in said housing maintainned at a pressure of about 1 to about 5 atmospheres; and (f) means for causing a flow of said insulating gas to the region between said contact assembly and the conductor as the contact assembly is moved into and out of contact with that conductor; said switch being adapted to be electrically connected into an electrical power distribution system having a voltage in the range of from about 1 to about 36 kilovolts.

44. A single phase ground enclosed load break switch for use in electrical circuits in the voltage range of from about 1 to about 36 kilovolts which comprises:

(a) a sealed cylindrical housing comprised substantially of metal having a generally cylindrical side wall and a pair of opposing end walls, said housing diameter in the range of from about 2 to about 6 inches (50–150 mm);

(b) first and second bushing means coaxially penetrating said cylindrical metal housing, one of said bushings being mounted proximate one end of said housing and the other being mounted proximate the other end of said housing, each of said bushings having an electrical conductor therethrough;

(c) a contact assembly capable of assuming a first position in which it is in physical and electrical contact with the electrical conductor of each of said bushings and a second position in which it is physically and electrically separated from at least one of said conductors;

(d) a bellows consisting essentially of metal mounted in and hermetically sealed directly to the cylindrical side wall of the housing and having a lever extending therethrough, and hermetically sealed directly thereto, said bellows being capable of a "rocking" motion as said lever is moved with respect to the cylindrical wall, said lever being connected through a crank to said contact assembly;

(e) means acting on said lever to cause axial motion of said contact assembly from said first position to said second position, thereby causing said contact assembly to be separated from at least on of said conductors thus interrupting current flow through the switch and from said second position to said first position, thereby causing said contact assembly to be in contact with each of said conductors thus providing a path for current flow through the switch; and (f) an insulating gas in said housing maintained at a pressure of about 1 to about 5 atmospheres absolute; said switch being adapted to be electrically connected between a load and a power course having a voltage in the range of from about 1 to about 36 kilovolts.

45. An assembly comprising a single phase ground enclosed load break switch for use in electrical circuits in the voltage range of from about 1 to about 36 kilovolts which comprises:

(a) a sealed cylindrical housing comprised substantially of metal having a diameter in the range of from about 2 to about 6 inches (50–150 mm);

(b) first and second bushing means coaxially penetrating said cylindrical metal housing, one of said bushings being mounted proximate one end of said housing and the other being mounted proximate the other end of said housing, each of said bushings having an electrical conductor therethrough;

(c) a contact assembly capable of assuming a first position in which it is in physical and electrical contact with the electrical conductor of each of said bushings and a second position in which it is physically and electrically separated from at least one of said conductors;

(d) means for causing said contact assembly to move from said first position to said second position, thereby causing said contact assembly to be separated from at least one of said conductors thus interrupting current flow through the switch and conversely from said second position to said first position, thereby causing said contact assembly to be in contact with each of said conductors thus providing a path for current flow through the switch; and (e) an insulating gas in said housing maintained at a pressure of about 1 to about 5 atmospheres absolute; and connected directly therewith an electrical power cable having a voltage in the range of from about 1 to about 36 kilovolts.

46. An assembly comprising:

(A) a single phase ground enclosed load break switch for use in electrical circuits in the voltage range of from about 1 to about 36 kilovolts which comprises:

(a) a sealed cylindrical housing comprised substantially of metal having a diameter in the range of from about 2 to about 6 inches (50–150 mm);

(b) first and second bushing means coaxially penetrating said cylindrical metal housing, one of said bushings being mounted proximate one end of said housing and the other being mounted proximate the other end of said housing, each of said bushings having an electrical conductor therethrough;

(c) a contact assembly capable of assuming a first position in which it is in physical and electrical contact with the electrical conductor of each of said bushings and a second position in which it is physically and electrically separated from at least one of said conductors;

(d) means for causing said contact assembly to move from said first position to said second position, thereby causing said contact assembly to be separated from at least one of said conductors thus interrupting current flow through the switch and conversely from said second position to said first position, with each of said conductors thus providing a path for current flow through the switch;

(e) an insulating gas in said housing maintained at a pressure of about 1 to about 5 atmospheres;

(B) a transformer having an output voltage range of from about 1 to about 36 kV, said transformer being equipped with an outlet bushing; and (C) a separable elbow connector comprising a molded elastomeric body portion having first and second bushing wells adapted to receive and electrically interconnect bushings of electrical equipment; the first bushing well being connected with a bushing of said switch and the second bushing well being connected with an outlet of said transformer.

47. A switch in accordance with claim 43, wherein said first and second bushing means coaxially penetrate said cylindrical metal housing.

48. A switch in accordance with claim 43, wherein said insulating gas in sulfur hexafluoride.

49. A switch in accordance with claim 48, wherein said $SF_6$ is under a pressure greater than 0.2 atmospheres.

* * * * *

UNITED STATES PATENT AND TRADEMARK OFFICE

CERTIFICATE OF CORRECTION

PATENT NO. : 4,663,504

DATED : May 5, 1987

INVENTOR(S): PHILIP BARKAN

It is certified that error appears in the above-identified patent and that said Letters Patent are hereby corrected as shown below.

Col. 9, line 59, please delete "te" and insert in lieu thereof -- the --.
Col. 14, line 21, please delete "surround" and insert in lieu thereof -- surrounding --.
Col. 16, line 43, please delete "biase" and insert in lieu thereof -- bias --.
Col. 20, line 46, please delete "consideration" and insert in lieu thereof -- considerable --.
Col. 27, line 37, please delete "comprises" and insert in lieu thereof -- comprised --.

Signed and Sealed this

Twenty-ninth Day of November, 1988

*Attest:*

DONALD J. QUIGG

*Attesting Officer*

*Commissioner of Patents and Trademarks*